United States Patent [19]

Gregory et al.

[11] Patent Number: 4,778,533

[45] Date of Patent: Oct. 18, 1988

[54] ALUMINUM-MAGNESIUM ALLOY SHEET PRODUCT AND METHOD FOR INHIBITING FORMATION OF A FILM THEREON

[75] Inventors: George T. Gregory, Lower Burrell; Donald L. Nock, New Kensington, both of Pa.

[73] Assignee: Aluminum Company of America, Pittsburgh, Pa.

[21] Appl. No.: 10,626

[22] Filed: Feb. 4, 1987

[51] Int. Cl.[4] ..... C23G 1/00; C23F 1/00

[52] U.S. Cl. ..... 134/29; 134/40

[58] Field of Search ..... 134/2, 3, 22.14, 40, 134/41, 25.1, 25.4, 25.3; 428/457

[56] References Cited

U.S. PATENT DOCUMENTS

| | | | |
|---|---|---|---|
| 3,655,467 | 4/1972 | Sopp, Jr. | 156/22 |
| 3,687,858 | 8/1972 | Geisler et al. | 252/156 |
| 3,900,370 | 8/1975 | Germscheid et al. | 204/38 A |
| 4,010,086 | 3/1977 | Barrett et al. | 204/141.5 |
| 4,320,023 | 3/1982 | White | 252/75 |
| 4,485,027 | 11/1984 | Rossmann et al. | 252/90 |

FOREIGN PATENT DOCUMENTS

| | | | |
|---|---|---|---|
| 753208 | 2/1967 | Canada | 134/16 |
| 59-205488 | 11/1984 | Japan . | |

OTHER PUBLICATIONS

Monsanto Technical Bulletin No. IC/SCS-323, entitled "Dequest® 2010 Phosphonate; For Scale and Corrosion Control, Chelation, Dispersion".

*Primary Examiner*—Nancy A. B. Swisher

*Attorney, Agent, or Firm*—Gary P. Topolosky

[57] ABSTRACT

An aluminum-magnesium alloy sheet product having improved levels of brightness for use as container stock including food containers and beverage container ends, said sheet product chemically treated with an alkaline-based cleaner containing a sufficient amount of a compound of 1-hydroxyethylidene-1, 1-diphosphonic acid (HEDP) to inhibit the formation of a magnesium oxide-containing film thereon. Preferably, the sheet product is cast from a 5000 Series aluminum alloy (Aluminum Association designation) and the cleaner contains between about 0.2–0.7% by weight of the HEDP compound. A method for improving the brightness levels of an aluminum-magnesium alloy sheet product is further disclosed. The method comprises chemically treating the sheet product with an alkaline-based cleaner containing between about 0.2–0.7% by weight of an HEDP compound to inhibit the formation of a magnesium oxide-containing film thereon.

11 Claims, No Drawings

ALUMINUM-MAGNESIUM ALLOY SHEET PRODUCT AND METHOD FOR INHIBITING FORMATION OF A FILM THEREON

BACKGROUND OF THE INVENTION

This invention relates to an aluminum-magnesium alloy sheet product for use as container stock including food containers and beverage container ends. The invention further relates to chemical treatment of said sheet product with an alkaline-based cleaning solution.

It is known to chemically treat aluminum alloy sheet product with an etchant or cleaning solution before painting, electrocoating, stamping, or the like. Conventional cleaning solutions remove machine residues, grinding and polishing pastes, oils, lubricants and other contaminants from the product surface. A typical cleaning solution includes an alkaline (caustic or carbonate) base and one or more of the following: a chelating agent for holding dissolved aluminum in solution, an emulsifier, a surfactant and a foam control agent. Previously known cleaners also included one or more inorganic phosphates, such as the aluminum cleaning solution taught in U.S. Pat. No. 3,655,467. Said cleaners have since been declared environmentally unsafe in several states.

When chemically treating aluminum-magnesium alloy sheet product with an alkaline-based cleaner, an unattractive reaction product film forms on the surface. This film is usually whitish, consists essentially of magnesium oxide and reduces the brightness levels of the sheet product on which it forms. The amount of film that forms may be reduced by maintaining such treatment variables as cleaning solution temperature and concentration, etch rate and exposure time at their optimums, once experimentally ascertained. Mechanical maintenance of these optimums does not completely inhibit the formation of film, however. Such maintenance is also less predictable than desired and costly in terms of the monitoring equipment, testing equipment, sheet product and man-hours required to determine the aforementioned optimums for each alloy sheet product.

In Japanese Pat. No. 59/205,488, there is disclosed a method of removing magnesium oxide film from an aluminum-magnesium alloy product to improve the adhesion of coatings to said product. More particularly, the reference teaches treating said product, after degreasing and/or etching, with an alkali-based solution which includes a sequestering agent of either 1% ethylenediamine tetraacetic acid (EDTA) or 3% sodium hexametaphosphate.

In still other methods of chemically treating aluminum-magnesium alloy sheet product, magnesium oxide is allowed to freely form on the product surface during alkaline etching. It is then later removed by treatment with an acidic solution, such as phosphoric acid or nitric acid. Two-stage cleaning processes are costly, however, in terms of the additional solutions, treatment areas and monitoring required. It is generally known to use 1-hydroxyethylidene-1,1-diphosphonic acid (HEDP) in conjunction with aluminum and aluminum alloys. For example, U.S. Pat. No. 3,687,858 teaches adding between 0.00–0.2% by weight of HEDP to a solution which comprises: from 0.5 to 15% caustic alkali, from 0.005 to 0.2% of a polycarboxylic acid salt having more than 10 carboxyl groups; and from 0.003% to 0.1% barium, strontium or, most preferably, calcium. Treatment with the above solution supposedly has a favorable effect on the adhesion of paints to aluminum surfaces in many instances. The reference is not specifically directed to aluminum-magnesium alloy sheet product, however. In fact, U.S. Pat. No. 3,687,858 neither teaches nor suggests inhibiting the formation of magnesium oxide-containing film on or improving the brightness levels of the sheet product herein.

Hydroxyphosphonic acids, such as HEDP, are used to retard precipitation of aluminum corrosion products from phosphate-borate type, ethylene glycol-based antifreeze formulations, as in U.S. Pat. No. 4,320,023. HEDP also seals the surfaces of anodized aluminum alloys according to U.S. Pat. No. 3,900,370. Lastly, U.S. Pat. No. 4,485,027 discloses degreasing aluminum workpieces with a solution containing 60 g/l of 50% NaOH and 50 g/l of the following dispersion: 18% boric acid; 77.5% orthophosphoric acid; 0.5% alkylbenzenesulfonic acid; 2% of an ethylene oxide adduct on a nonyl phenol; and 2% of 1-hydroxyethane-1,1-diphosphonic acid (another name for "HEDP"). The latter reference acknowledges formation of a white coating on metal surfaces treated with an orthophosphoric acid-containing solution. It does not, however, teach or suggest inhibiting the formation of magnesium oxide-containing film on aluminum-magnesium alloy sheet product.

It is further known to include HEDP in a strongly alkaline cleaning agent for preventing the formation of calcium deposits from hard water. In Canadian Pat. No. 753,208, however, large amounts of HEDP, between 0.5 and 20% by weight, are required to clean stainless steel or glass bottles.

In U.S. Pat. No. 4,010,086, there is disclosed a method for electrocleaning metals, preferably steel. The method comprises positioning metallic articles in a bath and passing electrical current therethrough. More particularly, said bath includes a sufficient amount of an alkaline metal hydroxide and an effective amount of a cleaning agent selected from the group consisting of 1-hydroethylidene-1,1-diphosphonic acid (HEDP), an alkali metal salt of HEDP and mixtures thereof. As stated therein, the addition of said cleaning agent enhances the cleaning power of sodium or potassium hydroxide to remove rolling oil, tramp mill oil and steel fines. Iron sequestering agents may also be added to this bath for preventing or removing steel tarnishes. The reference, as a whole though, neither teaches nor suggests any use of HEDP for inhibiting the formation of magnesium oxide-containing film on aluminum-magnesium alloy sheet product.

SUMMARY OF THE INVENTION

It is a principal object of the present invention to provide an aluminum-magnesium alloy sheet product having improved levels of brightness for use as container stock including food containers and beverage container ends.

It is a further object of the invention to provide a method for improving the levels of brightness of an aluminum-magnesium alloy sheet product by inhibiting the formation of a magnesium oxide-containing film thereon.

It is still a further object of the invention to provide an improved method for chemically treating aluminum-magnesium alloy sheet product with an environmentally safe, alkaline-based cleaner.

It is still a further object of the invention to provide a method for chemically treating aluminum-magnesium alloy sheet product which obviates the need to subsequently treat same with an acidic solution, thus overcoming the problems and disadvantages of the prior art mentioned above.

To accomplish the foregoing objects, there is disclosed an aluminum-magnesium alloy sheet product having improved levels of brightness for use as container stock including food containers and beverage container ends, said sheet product chemically treated with an alkaline-based cleaner containing a sufficient amount of a compound of 1-hydroxyethylidene-1,1-diphosphonic acid (HEDP) to inhibit the formation of a magnesium oxide-containing film thereon. Preferably, the sheet product is cast from a 5000 Series aluminum alloy (Aluminum Association designation) and the cleaner contains between about 0.2 to 0.7% by weight of the HEDP compound. Most preferably, the cleaner contains about 0.44% by weight of the HEDP compound.

There is further disclosed a method for inhibiting the formation of a magnesium oxide-containing film on an aluminum-magnesium alloy sheet product and a method for improving the brightness levels of same. These methods comprise chemically treating the sheet product with an alkaline-based cleaner containing between about 0.2–0.7% by weight of an HEDP compound. To a method of chemically treating aluminum-magnesium alloy sheet product with an alkaline-based cleaner, an improvement of the invention comprises adding a sufficient amount of an HEDP compound to the cleaner to inhibit the formation of a magnesium oxide-containing film thereon.

Further features, other objects and advantages of the invention will become clear from the detailed discussion of the preferred embodiments which follows.

DETAILED DESCRIPTION OF THE PREFERRED EMBODIMENTS

The aluminum-magnesium alloy sheet product of this invention has improved levels of brightness for having been chemically treated with an alkaline-based cleaner containing a sufficient amount of a compound of 1-hydroxyethylidene-1,1-diphosphonic acid (hereinafter "HEDP") to inhibit the formation of a magnesium oxide-containing film thereon. Preferably, the sheet product has an average thickness between about 0.009–0.0014 inch (0.229–0.356 mm). Within this thickness range, the sheet product is suitable for use as container stock. It is especially used for formation into food containers and beverage container ends by stamping, pressing or other known means. Most preferably, the sheet product of the invention is cast from a 5000 Series aluminum alloy (Aluminum Association designation). The aluminum alloys which more commonly develop film formation and brightness level problems include 5182, 5042, 5082, and 5352 (Aluminum Association designations).

After being rolled to the above preferred thickness level, aluminum-magnesium alloy sheet product is degreased and cleaned to remove any milling oils, lubricants, fines and the like from the product surface. Typically, the sheet product is chemically treated with an alkaline-based cleaner for this purpose. The cleaner includes a caustic or carbonate diluted in deionized water, and one or more of the following: a chelating agent for holding dissolved aluminum in solution, an emulsifier, a surfactant, and a foam controlling agent. After treatment with the above cleaner, aluminum-magnesium alloy sheet product is rinsed repeatedly and dried. During the aging of said sheet product, a whitish, opaque layer of film forms on the product surface. This film, which consists essentially of magnesium oxide, detracts from the appearance and value of the sheet product by reducing its levels of brightness. Depending upon such variables as cleaning solution temperature and concentration, etch rate and exposure time, most chemically treated aluminum-magnesium alloy sheet product is either streaked with vertically propagated, magnesium oxide deposits or completely covered with a thick cloudy layer of film.

By this invention, it was discovered that the addition of a sufficient amount of an HEDP compound to conventional alkaline-based cleaners inhibits the formation of magnesium oxide-containing film on aluminum-magnesium alloy sheet product. Minimal additions of HEDP also improve the brightness levels of the sheet product so treated. Particularly, HEDP compound is added to an existing alkaline-based cleaner to maintain a level of uncomplexed HEDP ions in a solution comprising said cleaner and the HEDP compound. The uncomplexed HEDP ions then combine readily with free magnesium ions on the product surface to inhibit the formation of film thereon. More particularly, an alkaline-based cleaner should contain between about 0.2–0.7% by weight of an HEDP compound according to this invention. HEDP may be added in amounts greater than 0.7% by weight. However, no additional benefits are realized by oversaturation with HEDP. In fact, a caustic- or carbonate-based cleaner containing about 0.44% by weight of an HEDP compound inhibits the formation of substantially all magnesium oxide-containing film on aluminummagnesium alloy sheet product.

The HEDP compound of this invention may consist essentially of 1-hydroxyethylidene-1,1-diphosphonic acid or most any alkali metal salt thereof. The salts which form because of the reactive nature of HEDP include magnesium, sodium, potassium, calcium and/or aluminum. The HEDP compound may be added to a cleaner in either a powder or liquid form. In the preferred embodiments of this invention, liquid HEDP, sold commercially by Monsanto as Dequest® 2010, is mixed with either a conventional carbonate-based cleaner or a caustic-based cleaner sold commercially by Chemical Systems, Inc. as "SW 254". Dequest® 2010 may either be poured directly into existing cleaning solutions in situ or neutralized outside the treatment area beforehand.

After the HEDP compound has been added, the resulting cleaning solution is applied to the product surface by any suitable means including spraying, dipping, wiping, flooding, or the like. Preferably, the product surface is chemically treated at a solution temperature between about 130°–170° F. (54°–77° C.) and an etch rate between about 20–200 MSF (mg/ft$^2$). Most preferably, the aluminum-magnesium alloy sheet product of the invention is treated at an etch rate between about 30–60 MSF.

The ability of this invention to inhibit the formation of magnesium oxide-containing film has been quantitatively measured for 5182 aluminum alloy sheet product. Particularly, a roll of said sheet product was etched with two (2) separate cleaning solutions at the above preferred temperatures for comparative purposes. The first solution comprised a conventional carbonate-based cleaner alone and resulted in the formation of between 7–15 MSF of film on the product surface at etch rates between 30–60 MSF. Treatment with the same solution at still higher etch rates of up to 200 MSF resulted in the formation of substantially more reaction product film. The second solution consisted of the same carbonate-based cleaner to which was added about 0.5% Dequest® 2010 by weight. Treatment with the latter solution at etch rates between 30–60 MSF resulted in a product surface absolutely free of magnesium oxide-containing film. When this solution was further modified with caustic to produce etch rates up to about 200 MSF, the 5182 product surface again had zero MSF of film formed thereon.

The invention also quantitatively improves the brightness levels for aluminum-magnesium alloy sheet product as evidenced by the data in Table 1. Particularly, the specularities of 5352 and 5182 alloy sheet product were measured with a Color Eye Signature "Model D" Integrating Sphere Abridged Spectrophotometer manufactured by Instrument Development Laboratories of Attleboro, Massachusetts before and after treatment with comparative caustic-based cleaners. More particularly, the specularities of said sheet products were measured in the rolling direction, then sections of both products were treated with either a solution of Chemical Systems' "SW 254" cleaner alone or a solution of "SW 254" to which was added about 3.5≅0.1 g/l of Dequest® 2010. The specularities for both treated sheet products were then measured and compared to the untreated specularity values to determine the following improvement percentages over untreated:

TABLE 1

Improved Levels of Brightness

| Test No. | Sheet Product | Cleaning Composition | Improvement in Specularity (versus untreated) |
|---|---|---|---|
| 1 | 5352 | SW 254 | 8.4% |
| | 5352 | SW 254 + Dequest 2010 | 12.4% |
| 2 | 5182 | SW 254 | 24.2% |
| | 5182 | SW 254 + Dequest 2010 | 36.3% |

Having described the presently preferred embodiments of the invention, it is to be understood that it may be otherwise embodied within the scope of the appended claims.

What is claimed is:

1. A method for substantially inhibiting the formation of a magnesium oxide-containing film on an aluminum-magnesium alloy sheet product suitable for use as container stock including food containers and beverage container ends, said method comprising:

chemically treating the sheet product without prior degreasing and/or etching by contacting the sheet product with a polycarboxylic acid-free, alkaline-based cleaner to which was added more than about 0.2% by weight of a compound containing 1-hydroxyethylidene-1,1-diphosphonic acid (HEDP).

2. The method of claim 1 wherein the sheet product is cast from a 5000 Series aluminum alloy (Aluminum Association desgination).

3. The method of claim 1 wherein the cleaner contains between about 0.25–0.7% by weight of the HEDP compound.

4. The method of claim 3 wherein the cleaner contains about 0.44% by weight of the HEDP compound.

5. A method for near simultaneously cleaning, etching and improving the brigtness levels of aluminum-magnesium alloy sheet product for use as container stock including food containers and beverage container ends, said method consisting essentially of:

chemically treating the sheet product with a polycarboxylic acid-free, alkaline-based cleaner to which has been added between about 0.25–0.7% by weight of a compound containing 1-hydroxyethylidene-1,1-diphosphonic acid (HEDP).

6. The method of claim 5 wherein the cleaner contains about 0.44% by weight of the HEDP compound.

7. The method of claim 5 wherein the sheet product is cast from a 5000 Series aluminum alloy (Aluminum Association desgination).

8. In a method for chemically treating aluminum-magnesium alloy sheet product with an alkaline-based cleaner which contains substantially no polycarboxylic acids, the improvement comprises:

adding a sufficient amount of a compound containing 1-hydroxyethylidene-1,1-diphosphonic acid to the cleaner prior to chemically treating the sheet product with said cleaner for inhibiting the formation of a magnesium oxide-containing film on the sheet product.

9. The improvement of claim 8 which comprises adding substantially only 0.25–07% by weight of the HEDP compound to the cleaner prior to chemically treating the sheet product with said cleaner.

10. The improvement of claim 9 wherein the cleaner contains about 0.44% by weight of the HEDP compound.

11. The improvement of claim 8 wherein the sheet product is cast from a 5000 Series aluminum alloy (Aluminum Association desgination).

* * * * *

UNITED STATES PATENT AND TRADEMARK OFFICE

CERTIFICATE OF CORRECTION

PATENT NO. : 4,778,533

DATED : October 18, 1988

INVENTOR(S) : George T. Gregory and Donald L. Nock

It is certified that error appears in the above-identified patent and that said Letters Patent is hereby corrected as shown below:

| | |
|---|---|
| Col. 1, line 63 | Change "0.00-0.2%" to -- 0.005-0.2% -- |
| Col. 4, line 36 | Change "aluminummagnesium" to -- aluminum-magnesium -- |
| Col. 5, lines 10-11 | Change "oxidecon-taining" to -- oxide-containing -- |
| Col. 5, line 29 | Change "3.5 ≅ 0.1 g/l" to -- 3.5 ± 0.1 g/l -- |
| Claim 5, Col. 6, l. 19 | Change "brigtness" to --brightness-- |
| Claim 2, Col. 6, l. 12; Claim 7, Col. 6, l. 32; Claim 11, Col. 6, l. 52 | Change "desgination" to --designation-- |
| Claim 9, Col. 6, l. 44 | After "only", insert --about-- |
| Claim 9, Col. 6, l. 44 | Change "0.25-07%" to -- 0.25-0.7% -- |

Signed and Sealed this

Twenty-fifth Day of April, 1989

*Attest:*

DONALD J. QUIGG

*Attesting Officer*

*Commissioner of Patents and Trademarks*